US005828168A

United States Patent [19]

Koh

[11] Patent Number: 5,828,168

[45] Date of Patent: Oct. 27, 1998

[54] DEFLECTION YOKE WITH INNER ARM

[75] Inventor: Chang Seop Koh, Seoul, Rep. of Korea

[73] Assignee: Samsung Electro-Mechanics Co., Ltd., Suwon, Rep. of Korea

[21] Appl. No.: 692,676

[22] Filed: Aug. 6, 1996

[30] Foreign Application Priority Data

Nov. 30, 1995 [KR] Rep. of Korea ..... 1995-45371

[51] Int. Cl.[6] ..... H01J 29/70

[52] U.S. Cl. ..... 313/440; 313/46; 335/210; 348/829

[58] Field of Search ..... 313/440, 46; 335/210, 335/213, 300; 348/828, 829

[56] References Cited

U.S. PATENT DOCUMENTS 4,246,560 1/1981 Shimizu et al. ..... 335/212

4,737,752 4/1988 Kriz ..... 335/210

4,749,975 6/1988 Tokita et al. ..... 335/210

4,853,588 8/1989 Ohtsu et al. ..... 313/440

*Primary Examiner*—George M. Dombroske

*Assistant Examiner*—Harshad Patel

*Attorney, Agent, or Firm*—Ladas & Parry

[57] ABSTRACT

A deflection yoke comprises an inner arm formed with at least one heat insulator, is disposed between a coil separator and a vertical coil, and has a front face in a rectangular shape. This deflection yoke provide a pictorial image of good quality by preventing overheat due to an eddy current induced from a high frequency-current and preventing distortions of a magnetic field.

4 Claims, 2 Drawing Sheets

DIRECTION OF VERTICAL MAGNETIC FIELD

DIRECTION OF HORIZONTAL MAGNETIC FIELD

DEFLECTION YOKE WITH INNER ARM

BACKGROUND OF THE INVENTION

1. Field of the Invention

The present invention relates to a deflection yoke (hereinafter referred to as "DY") used in a color TV or a computer monitor etc. More particularly, the invention relates to a DY having an inner arm formed with a heat insulator which permits obtaining a pictorial image of good quality by preventing overheating due to an eddy current, and provided between a coil separator and a vertical deflection coil.

2. Description of the Prior Art

In general, an inner arm is fixed to the intermediate portion of a DY in pairs and produces an intensive barrel-type magnetic field to satisfy a convergence characteristic. Additionally, a screen part of the inner arm corrects a distortion characteristic. Such inner arm is composed of a magnetic material with high magnetic permeability, for example, a cold rolled silicon steel plate.

The convergence characteristic referred to herein is to converge three electron beams of red (R), green (G) and blue (B) color on a surface of a shadow mask and thereby to prevent color distortion of a pictorial image.

FIG. 1 illustrates an inner arm in a plan view which has a rectangular shape with a dimension of 20×10×0.5 mm in length (c) x height (a) x width (b).

The inner arm in a DY is disposed in pairs between two vertical coils and a coil separator, respectively.

This is because it is required to generate a pin-shaped magnetic field toward a screen of a DY for reducing E/W distortion among picture characteristics and to form a barrel-type magnetic field for improving the convergence characteristic of an electron gun. For this reason, the DY is provided with the inner arm in order to intensify the barrel-type magnetic field. This trend toward the inner arm is principally applied to a DY for a large color monitor and multimedia.

The conventional inner arm of the type, however, has a drawback in that in case of a DY for the computer monitor and multimedia, due to high frequency of the current flowing through a horizontal coil, a large eddy current is induced in the inner arm such that causes it to overheat, and thus the inner arm is bent or the coil separator is deformed by overheating to distort the magnetic fields in the CRT, resulting in deterioration of the picture characteristics.

Particularly, high frequency of the current may considerably deteriorate the characteristics of a DY because the amount of heat generation is proportional to the square of frequency.

SUMMARY OF THE INVENTION

Starting from the aforementioned problem, it is an object of the present invention to provide DY having an inner arm which can prevent overheat due to an eddy current resulting from high frequency by means of heat insulation means formed therewith and which permits obtaining a pictorial image of good quality by preventing distortions of a magnetic field.

The characteristic of the present invention for attainment of this object is that in a DY including a coil separator, a vertical coil and a horizontal coil, a DY comprises an inner arm formed with at least one heat insulation means and disposed between the coil separator and the vertical coil.

The heat insulation means can be formed by a slit or a hole.

BRIEF DESCRIPTION OF THE DRAWINGS

The above and other objects, features and advantages of the present invention will become more readily apparent from following description with reference to the accompanying drawings in which.

DESCRIPTION OF THE PREFERRED EMBODIMENTS

Figure 1:
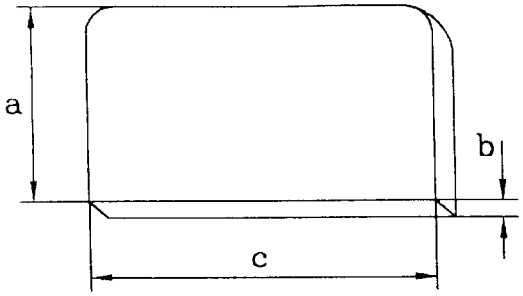
FIG. 1 PRIOR ART
FIG. 1 is a plan view of an inner arm of the prior art.
Figure 2:
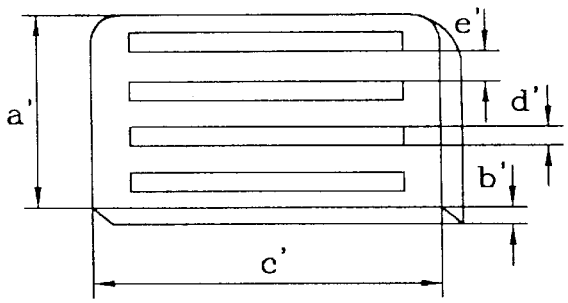
FIG. 2 is a plan view of an inner arm of the present invention.

FIG. 2 illustrates an inner arm of the present invention in a plan view. The configuration and working effect of the invention will be described below.

Reference numbers d' and e' in FIG. 2 indicate a width of a slit and a distance between the slits, respectively. The width (d') and the distance (e') of the slit may be as small as possible. The smaller they are, the higher the electric resistance is and therefore the less eddy current flows.

Figure 3:
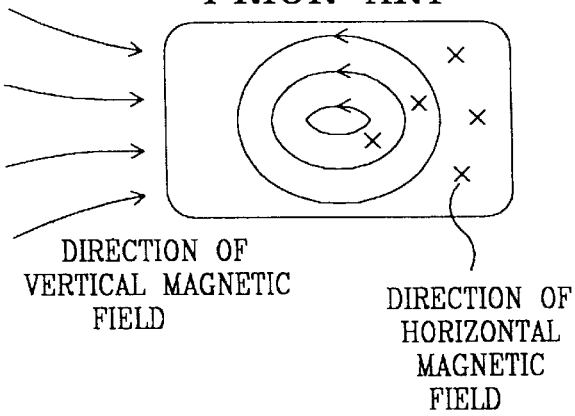
FIG. 3 PRIOR ART
FIG. 3 shows flow paths of an eddy current according to an embodiment of the inner arm of the prior art.
Figure 4:
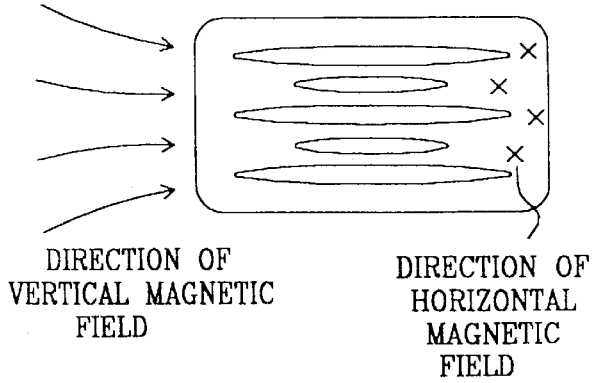
FIG. 4 shows flow paths of an eddy current according to an embodiment of the inner arm of the present invention.

Since a magnetic field produced by a horizontal coil of DY passes through the inner arm vertically, the eddy current according to the conventional inner arm flows as shown in FIG. 3. Then, the eddy current flows in quantity because electric resistance is large in area and small in length, where the length means a path of the circular eddy current.

With respect to the inner arm of the present invention, however, the path of eddy current extends to a great extent because the eddy current is incapable of flowing through the slit.

In this case, electric resistance is higher in accordance with the decrease of the distance (d') and so reduces the eddy current more effectively.

Furthermore, considering that the inner arm is used for the purpose of intensifying a barrel-type magnetic field, it is preferred that the width (d') of the slit is as small as possible.

Especially, it is essential that the slits should be parallel to the direction of the magnetic field generated in the vertical coil when the inner arm is mounted with a DY. Otherwise, the magnetic field weakens.

Figure 5:
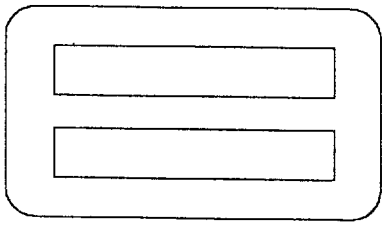
FIGS. 5 to 7 are plan views showing other embodiments of the inner arm of the present invention.
Figure 6:
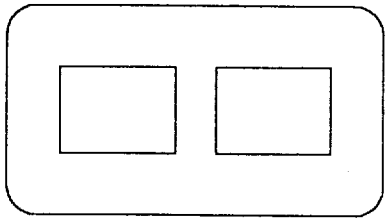
Figure 7:
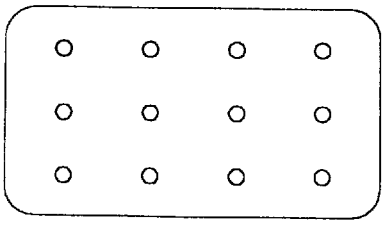

FIGS. 5 to 7 illustrate other embodiments of the invention, in which each slit is different from each other in its configuration, shape and dimension. The aim of such modifications is to change the path of eddy current and increase electric resistance.

In FIG. 7 there is seen an inner arm having a hole as another example of heat insulator of the invention.

By providing a DY with the inner arm according to the present invention, the eddy current is suppressed and heat is prevented even at higher frequencies. Also, since distortions of the magnetic field is avoided, a pictorial image of good quality can be obtained.

Although the present invention has been described with reference to preferred embodiments, it will be understood that various changes and modifications may be made by those of skill in the art without departing from the spirit and the scope of the invention as set forth in the following claims.

What is claimed is:

1. A deflection yoke comprising:

a coil separator for a horizontal coil and a vertical coil; an inner arm of rectangular shape for installation between the coil separator and vertical coil for changing a vertical magnetic field into a barrel-shape magnetic field; and a slit in the inner arm for insulting heat generated by a horizontal magnetic field of the horizontal coil.

2. The deflection yoke of claim 1, wherein the slit is parallel with a pass direction of a magnetic field generated from the vertical coil.

3. The deflection yoke of claim 1, wherein the slit is parallel with a longitudinal direction of the inner arm.

4. The deflection yoke of claim 1, wherein the slit is parallel with a lateral direction of the inner arm.

* * * * *